US006648079B2

(12) United States Patent
Deimel et al.

(10) Patent No.: US 6,648,079 B2
(45) Date of Patent: Nov. 18, 2003

(54) PROTECTIVE APPARATUS FOR PREVENTING THE INFILTRATION OF CONTAMINANTS IN A FLUID-OPERATED PERCUSSION DEVICE

(75) Inventors: Thomas Deimel, Mülheim (DE); Markus Mellwig, Hagen (DE); Heinz-Jürgen Prokop, Ratingen (DE)

(73) Assignee: Atlas Copco Construction Tools, Essen (DE)

( * ) Notice: Subject to any disclaimer, the term of this patent is extended or adjusted under 35 U.S.C. 154(b) by 101 days.

(21) Appl. No.: 09/809,136

(22) Filed: Mar. 16, 2001

(65) Prior Publication Data

US 2001/0022227 A1 Sep. 20, 2001

(30) Foreign Application Priority Data

Mar. 16, 2000 (DE) ..... 100 12 916

(51) Int. Cl.[7] ..... B25D 17/00
(52) U.S. Cl. ..... 173/91; 173/114; 173/210
(58) Field of Search ..... 173/71, 91, 114, 173/128, 210, 206; 279/19, 19.6, 19.7; 175/296, 417

(56) References Cited

U.S. PATENT DOCUMENTS 2,867,462 A * 1/1959 Nielsen ..... 277/555
3,371,730 A * 3/1968 Newman ..... 175/300
3,585,301 A * 6/1971 Newman ..... 175/300
3,995,702 A * 12/1976 Klimashko et al. ..... 173/91
5,143,162 A * 9/1992 Lyon et al. ..... 175/100
5,562,170 A 10/1996 Wolfer et al. ..... 175/296
5,873,579 A 2/1999 Prokop et al.

FOREIGN PATENT DOCUMENTS

| | | |
|---|---|---|
| DE | 196 28 815 | 1/1998 |
| DE | 198 01 297 | 4/1999 |
| EP | 0 922 539 | 6/1999 |

* cited by examiner

*Primary Examiner*—Stephen F. Gerrity
*Assistant Examiner*—Chukwurah Nathaniel
(74) *Attorney, Agent, or Firm*—Venable; Norman N. Kunitz

(57) ABSTRACT

A protective apparatus for preventing the infiltration of contaminants in a fluid-operated percussion device, having a striking tool (3) that is guided to move in a housing (2) and is driven by a percussion piston in the striking direction (arrow 1), and a seal (7) that is supported at least indirectly on the housing (2), on the one hand, and on the striking tool (3), on the other hand, and has a securing segment that is fixedly disposed with respect to either the housing or the striking tool. The seal (7) is disposed between the inner guide portion (5*b*) of the striking-tool guide and the theoretical striking plane (4) of the percussive piston on the striking tool (3), when seen in the direction opposite the striking direction (arrow 1), such that the countersurface (3*e*) for the seal, which countersurface moves relative to the securing segment (7*a*) of the seal (7) and is in contact with the seal, is unaffected by wear.

18 Claims, 3 Drawing Sheets

PROTECTIVE APPARATUS FOR PREVENTING THE INFILTRATION OF CONTAMINANTS IN A FLUID-OPERATED PERCUSSION DEVICE

CROSS REFERENCE TO RELATED APPLICATION

This application claims the priority of German patent Application No. 100 12 916.1 filed Mar. 16, 2000, which is incorporated herein by reference.

BACKGROUND OF THE INVENTION

The invention relates to a protective apparatus for preventing the infiltration of contaminants in a fluid-operated percussion device, having a striking tool that is guided to move in a housing, and is driven by a percussion piston in the striking direction, and a seal that is supported at least indirectly on the housing, on the one hand, and on the striking tool, on the other hand, and has a securing portion that is fixedly disposed with respect to either the housing or the striking tool.

The publication DE 196 28 815 C1 discloses a protective apparatus of the general type mentioned at the outset. This apparatus shields the striking tool at its throughgoing opening from the housing that serves to support the striking tool against the outside environment, and thereby prevents the penetration of even small to dust-type contaminants into the region of the striking-tool guide.

Due to the extraordinarily-high stress on the striking tool, it must be heavily lubricated in the region of its guide, which typically comprises a plurality of guide portions that are spatially separated from one another in the longitudinal direction of the striking tool. Consequently, lubricants, in particular, infiltrate the region of the striking plane between the percussive piston and the striking surface of the striking tool facing the piston. With extended use, accumulation or deposits formed in this manner cause damage to the percussive piston and at least at the striking surface of the striking tool, thereby diminishing the effectiveness and economic viability of the entire percussion device.

SUMMARY OF THE INVENTION

It is the object of the invention to embody the general type protective apparatus mentioned above such that it prevents the infiltration of contaminants in the connection to the striking-tool guide in the direction of the percussive piston.

The object is accomplished according to the present invention by a percussion device having a protective apparatus for preventing the infiltration of contaminants, said device comprising: a fluid-operated percussion device, having a striking tool that is guided to move in a housing by a striking tool guide, and is driven by a percussion piston in the striking direction, and a seal that is supported at least indirectly on one of the housing and the striking tool and has a securing portion that is fixedly disposed with respect to one of the housing and the striking tool, with the seal being disposed between an inner guide portion of the striking-tool guide and a theoretical striking plane of the percussive piston on the striking tool, when seen in the direction opposite the striking direction, such that a countersurface on one of the striking tool and the housing tool, and which moves relative to the securing portion of the seal and is in contact with the seal, is unaffected by wear.

The basic concept of the invention is to arrange the seal between the inner guide portion, when seen in the opposite direction of the striking direction, of the striking-tool guide and the theoretical striking plane of the percussive piston against the striking tool such that the countersurface that moves relative to the securing segment of the seal and is in contact with the seal, is wear-free.

In other words, for the purpose of protecting the seal resting against the countersurface, over which the seal travels due to the back-and-forth movement of the striking tool inside the housing, against untimely damage, the countersurface is disposed in a region that sustains no damage, even with a conservative estimation of the anticipated, greatest-possible wear.

In view of the fact that the inner guide portion of the striking-tool guide facing the percussive piston must also be adequately lubricated, the seal is disposed such that it is effective behind the inner guide portion when seen in the direction opposite the striking direction. Hence, the infiltration of undesired contaminants from the region of the inner guide portion in the direction of the percussive piston can be extensively prevented, provided that the function of the seal is only impaired insignificantly, or not at all.

In a modification of the invention, the seal is disposed behind the inner guide portion and in front of a cushioning ring secured to the housing when seen in the direction opposite the striking direction, with the ring serving as a stop for limiting the motion clearance of the striking tool in the direction opposite the striking direction.

With this arrangement, the seal assumes a position between the inner guide portion (which faces the percussive piston) and the cushioning ring when seen in the axial direction of the striking tool.

As an alternative modification within the scope of the invention, the seal can also be displaced in the direction of the theoretical striking plane of the percussive piston.

In this type of embodiment, the seal is disposed between the theoretical striking plane of the percussive piston and a cushioning ring that is secured to the housing, when seen in the longitudinal direction of the striking tool, and serves as a stop for limiting the motion clearance of the striking tool in the direction opposite the striking direction, and lies behind the inner guide portion when seen in this direction.

In other words, the following sequence occurs in the aforementioned viewing direction: inner guide portion/cushioning ring/seal/theoretical striking plane of the percussive piston.

Accordingly, the cushioning ring additionally spaces the sealing region, in which the seal is effective, physically from the inner guide portion of the striking-tool guide.

The maintenance of the percussion device and the exchange of the seal can be simplified through the connection of the securing portion of the seal to an exchangeable receiving sleeve, which is in turn secured to the striking tool or a housing.

In the case of the latter variation, the receiving sleeve can also constitute a component of the cushioning ring, i.e., it can be combined with the ring to form a unit that is connected to the housing.

The protective apparatus is preferably embodied such that the motion clearance of the striking tool is shorter in the axial direction than the length of the countersurface on which the seal is supported. Consequently, even in extended operations, it can be ensured that the countersurface is not subjected to otherwise occurring wear, so the seal is protected against untimely damage.

Depending on the other circumstances, the seal can be embodied essentially as an inward directed or facing seal or as an outward directed or facing seal. Consequently, the securing portion of the seal is fixedly held relative to either the housing or the striking tool.

In the case of the embodiment as an inward directed seal, the countersurface over which the seal travels can be kept free from wear in that the diameter of the striking tool is smaller over the length of the countersurface than its diameter in the region of the inner guide portion. The difference in diameters should be in an order of magnitude that takes into account the anticipated wear in the region of the inner guide portion.

The discussed embodiment with an inward and/or outward directed seal can be further modified in that, in the installed state, the inside diameter of the inward directed seal is larger than the diameter of the striking surface of the striking tool that faces the percussive piston. Accordingly, the seal is widened when the striking tool is installed, so the seal rests in an elastic manner, and with prestressing, against the countersurface moving relative to the seal.

In an advantageous embodiment of the subject of the invention, the seal has at least one sealing lip that extends at an incline in the striking direction, and is kept in contact in an elastic manner against the countersurface.

It has proven advantageous to select the ratio of the length of each sealing lip to the greatest-possible transverse offset of the striking tool, relative to the housing, to be at least 1, preferably more than 1 to 3. Thus, it is ensured the seal also exerts an adequate sealing effect, even with the anticipated transverse movements of the striking tool inside the housing.

The invention is described in detail below via of embodiments illustrated in the schematic drawings.

DETAILED DESCRIPTION OF THE PREFERRED EMBODIMENTS

Figure 1:
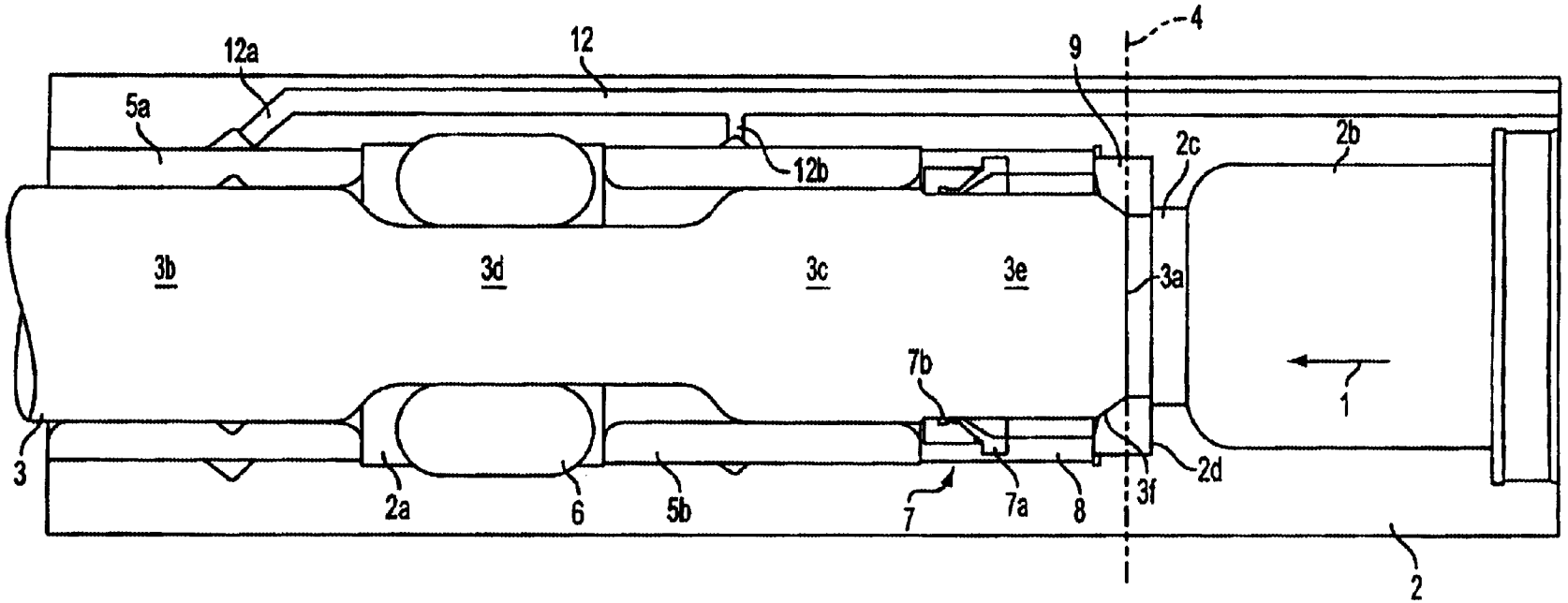
FIG. 1 is a longitudinal section through the lower part of a hydraulic hammer, in which a striking tool is guided to move in the longitudinal direction, with a seal according to the invention that is embodied as an inward directed seal disposed in the region between the inner guide portion of the striking tool and a cushioning ring.

The fluid-operated percussion device in the form of a hydraulic hammer can be embodied in a known manner, aside from the protective apparatus (still to be described below) for preventing the infiltration of contaminants, and has as its primary components, which are not shown, a percussive piston that moves longitudinally in the upper part of a housing 2, and alternately executes a work stroke in the striking direction (arrow 1) and a return stroke in the direction opposite the striking direction, as dictated by a control. The percussive piston projects (from the right side in the drawing) into a lower housing part and transmits its striking energy, via the striking surface 3*a* facing it, onto a striking tool in the form of a chisel 3.

The theoretical striking plane in which the percussive piston strikes the striking surface 3*a* is indicated by a dot-dash line 4.

The housing 2 has two long bore portions 2*a* and 2*b*, which merge over a short, narrowed bore portion 2*c*.

For the mobile support of the chisel 3 in the housing 2, a striking-tool guide 5 which comprises an outer annular guide portion 5*a* and an inner guide portion 5*b* that is physically separated or spaced from the outer portion 5*a* when seen in the direction opposite the striking direction (arrow 1), is secured inside the bore portion 2*a*. Two oval-shaped retaining elements 6, which limit the motion clearance of the chisel 3 in the striking direction (arrow 1), i.e., to the left in the illustration, are fixedly mounted between the two guide portions 5*a* and 5*b*.

In the region of the guide portions 5*a*, 5*b*, the chisel 3 has guide surfaces 3*b* and 3*c*, which are adapted to the size of guide portions 5*a* and 6*b*, and, in the region of the retaining elements 6, change over into a longitudinal portion 3*d* with flattened or milled regions that are associated with the retaining elements 6.

To prevent the infiltration of contaminants, particularly lubricants, into the region of the theoretical striking plane 4, a seal 7, which is embodied as an inward directed seal, and whose securing segment 7*a* is connected to an exchangeable receiving sleeve 8, is disposed behind the inner guide portion 5*b* when seen in the direction opposite the striking direction (arrow 1). This seal 7, which is stationary relative to the housing 2, is located between the inner guide portion 5*b* and a cushioning ring 9, which limits the motion clearance of the inner end of chisel 3 in the direction opposite the striking direction (arrow 1). The position of the ring 9 inside the housing 2 is established by a shoulder 2*d* on the bore segment 2*d*.

The seal 7 is further disposed such that its sealing lip 7*b* is held in contact in an elastic manner against a wear-free countersurface 3*e* of the chisel 3. Taking into account the greatest permissible wear in the region of the striking-tool guide 5 and the resulting transverse movements of the chisel 3, the diameter of the countersurface 3*e* is distinctly smaller than the diameter of the longitudinal portion 3*c* in the region of the inner guide portion 5*b*. This ensures that the sealing lip 7*b* always cooperates with a countersurface 3*e* with a flawless surface condition.

As shown in, for example, FIG. 1, in the simplest case, the seal 7 is provided with only one sealing lip 7*b* that extends at an incline in the striking direction (arrow 1), thereby sealing the space between the exchangeable receiving ring 8 and the wear-free countersurface 3*e*.

The length of the sealing lip 7*b* is advantageously selected such that the ratio of its length to the largest-possible transverse offset of the chisel 3 relative to the housing 2 has a value greater than 1.

It also ensues from the drawing that the diameter of the sealing lip 7*b* is larger than the diameter of the striking surface 3*a* in the installed state. The striking surface 3*a* changes over into the countersurface 3*e*, which has a larger diameter, thereby forming a frustoconical portion 3*f*.

Depending on the embodiment of the countersurface 3*e* and the frustoconical segment 3*f* relative to the cushioning ring 9, the chisel 3 can assume only a retracted position in which the striking surface 3*a* is located at the height of the cushioning ring 9 and in front of the narrowed bore portion 2*c* when seen in the direction opposite the striking direction (arrow 1).

To ensure that the sealing lip 7*b* is only supported on the wear-free countersurface 3*e*, the motion clearance of the chisel 3 is smaller in the axial direction than the length of the countersurface 3*e* over which the sealing lip 7*b* travels.

Figure 2:
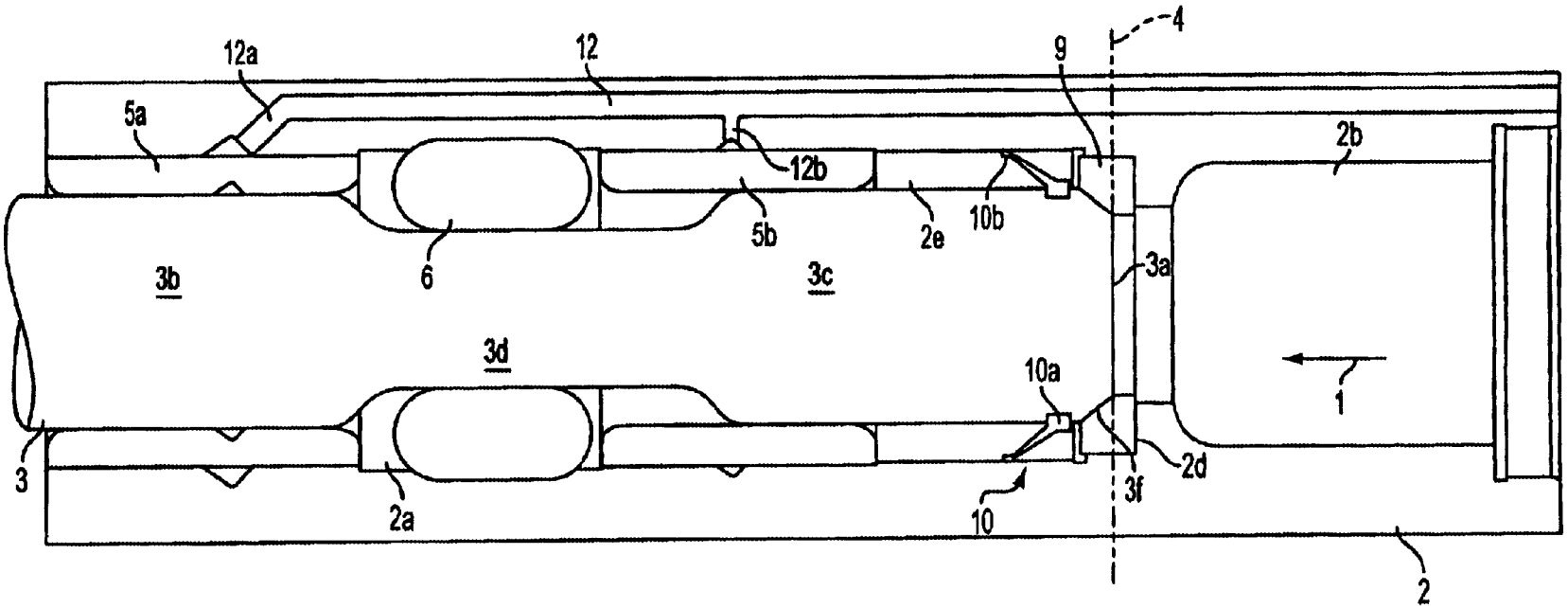
FIG. 2 is a longitudinal section through the lower part of a hydraulic hammer, in which a striking tool is guided to move in the longitudinal direction, with a seal according to the invention that is embodied as an outward directed seal disposed in the region between the inner guide portion for the striking tool and a cushioning ring for the end of the striking tool.

The embodiment according to FIG. 2 is essentially distinguished from that of FIG. 1 in that the seal disposed between the inner guide portion 5*b* and the cushioning ring 9 is embodied as an outwardly directed seal 10. Accordingly, the securing segment 10*a* of the outwardly directed seal 10 is fixedly held relative to the chisel 3, e.g., is mounted on the portion 3*c* of the chisel 3, while the sealing lip 10*b* rests in an elastic manner against a countersurface 2*e* of the housing 2. This surface represents a wear-free bore portion of the housing portion 2 and adjoins the inner guide portion 5*b* when seen in the direction opposite the striking direction (arrow 1).

In this case as well, the outwardly directed seal 10 has a sealing lip 10*b* that extends at an incline in the striking direction (arrow 1), i.e., starting from its securing segment 10*a* on the chisel 3, the sealing lip 10*b* is oriented at an incline toward the wear-free countersurface 2*e* in the striking direction.

The length of the sealing lip 10*b* is selected such that it also exerts a sufficient sealing effect, even with the anticipated transverse movements of the chisel 3 inside the housing 2, namely by reliably shielding the space between the chisel 3 and the countersurface 2*e* in the direction of the cushioning ring 9.

Figure 3:
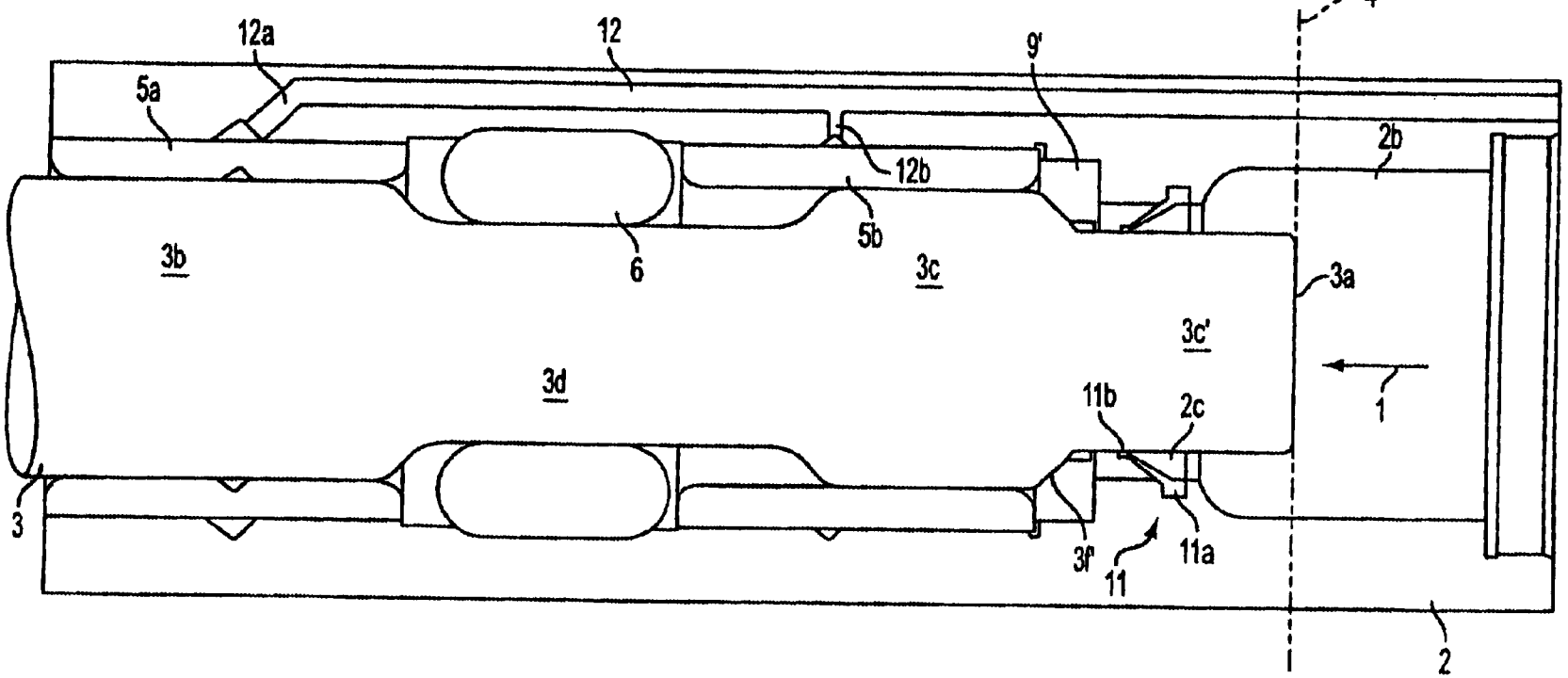
FIG. 3 is a longitudinal section through the lower part of a hydraulic hammer, in which a striking tool is guided to move in the longitudinal direction, with a seal according to the invention that is embodied as an inward directed seal disposed in the region between a cushioning ring for the inner guide portion and the theoretical striking plane of the percussive piston on the striking tool.

In the embodiment according to FIG. 3, the seal 11, embodied as an inwardly directed seal, adjoins the cushioning ring 9 from behind, and is disposed in front of the theoretical striking plane 4, when seen in the direction opposite the striking direction (arrow 1).

Unlike in the above-described embodiments, the following sequence results: inner guide portion 5*b*/cushioning ring 9'/inwardly directed seal 11/theoretical striking plane 4.

To prevent the infiltration of contaminants from the region of the striking-tool guide 5 in the direction of the bore portion 2*b*, the chisel 3 has a reduced diameter extension that projects beyond portion 3*c* via a frustoconical portion 3*f*' in the direction opposite the striking distance (arrow 1), and has a countersurface 3*e*' that cooperates with the inwardly directed seal 11. In the indicated retracted end position, in which the chisel 3 is supported on the cushioning ring 9' by the frustoconical portion 3*f*, the countersurface 3*e*' projects through the bore portion 2*c* into the bore portion 2*b*, in which the theoretical striking plane 4 is also located.

Whereas the securing portion 11*a* of the inwardly directed seal 11 is fixedly held relative to the housing 2 in the region of the bore portion 2*c*, the sealing lip 11*b* is supported in an elastic manner against the countersurface 3*e*' again at an incline in the striking direction (arrow 1), that moves relative to the lip 11*b*.

To ensure that the sealing lip 11*b* is not prematurely damaged, the length of the countersurface 3*e*' in the axial direction is selected such that the striking surface 3*a* is also sufficiently spaced from the sealing lip 11*b* in the extended end position of the chisel 3 (i.e., in the extended end position shown toward the left in the figure).

In other words, the axial length of the countersurface 3*e*' is selected such that the length traversed by the sealing lip 11*b* is shorter than the entire available length of the countersurface 3*e*', which has been adapted to the motion clearance of the chisel 3.

As can also be seen in the drawing, the sealing lip 11*b* is also supported on the countersurface 3*e*' with sufficient spacing from the cushioning ring 9 in the retracted (to the right) shown end position of the chisel 3, so incidences of wear in the region of the frustoconical portion 3*f* cannot impact the sealing region.

Borrowing from the embodiment according to FIG. 1, the embodiment of FIG. 3 can also be modified such that the inwardly directed seal 11 is connected by its securing segment 11*a* to an exchangeable receiving sleeve such as the sleeve 8. In principle, all of the embodiments can include seals that have a plurality of consecutive sealing lips.

As shown in the above-described FIGS. 1–3, the housing 2 is provided with a lubricant-supply conduit 12 that extends in the longitudinal direction and introduces lubricant into the region of the outer guide portion 5*a* via an inclined bore portion 12*a*, and into the region of the inside guide segment 5*b* via a transverse bore 12*b*.

The advantage attained with the invention is that relatively simple means prevent the infiltration of contaminants from the striking-tool guide 5 in the direction of the striking surface 3*a* and the theoretical striking plane 4.

The invention now being fully described, it will be apparent to one of the ordinary skill in the art that many changes and modifications can be made thereto without departing from the spirit or scope of the invention as set forth herein.

We claim:

1. A percussion device having a protective apparatus for preventing the infiltration of contaminants, said device comprising: a fluid-operated percussion device, having a striking tool that is guided to move in a housing by a striking tool guide, which has inner and outer axially spaced annular guide portions each having an inner surface that engages a portion of a circumferential surface of the striking tool, and is driven by a percussion piston in the striking direction, and a seal that is supported at least indirectly on one of the housing and the striking tool and has a securing portion that is fixedly disposed with respect to the other of the housing and the striking tool, with the seal being disposed between an inner end of the inner guide portion of the striking-tool guide and a theoretical striking plane of the percussive piston on the striking tool, when seen in the direction opposite the striking direction, and the support for the seal is a countersurface provided on said one of the striking tool and the housing, which countersurface moves relative to the securing portion of the seal, is in contact with the seal, and is unaffected by wear in that it is not engaged by the inner surface of the tool guide or the circumferential surface of the striking tool.

2. The device according to claim 1, wherein the seal is disposed behind the inner guide portion and in front of a cushioning ring secured to the housing when seen in a direction opposite the striking direction, with the ring serving as a stop for limiting the motion clearance of the striking tool in the direction opposite the striking direction (arrow 1).

3. The device according to claim 2, wherein the seal is connected by its securing portion to an exchangeable receiving sleeve that in turn is secured to one of the striking tool and the housing.

4. The device according to claim 3, wherein the receiving sleeve constitutes a component of the cushioning ring.

5. The device according to claim 1, wherein when seen in the longitudinal direction of the striking tool, the seal is disposed between the theoretical striking plane of the percussive piston and a cushioning ring that is secured to the housing, and serves as a stop for limiting the motion clearance of the striking tool in the direction opposite the striking direction (arrow 1), and lies behind the inner guide portion when seen in this direction.

6. The device according to claim 5, wherein the seal is connected by its securing portion to an exchangeable receiving sleeve that, in turn, is secured to one of the striking tool and the housing.

7. The device according to claim 6, wherein the receiving sleeve constitutes a component of the cushioning ring.

8. The device according to claim 1, wherein a motion clearance of the striking tool in an axial direction is smaller than the length of the countersurface that supports the seal.

9. The device according to claim 1, wherein the securing portion of the seal, which is embodied as a lip seal, is fixedly held relative to the housing.

10. The device according to claim 9, wherein a diameter of the striking tool over the length of the countersurface is smaller than a diameter of the striking tool in the region of the inner guide portion.

11. The device according to claim 1, wherein the seal is embodied as an outwardly directed seal and is fixedly held by its securing portion relative to the striking tool.

12. The device according to claim 11, wherein the countersurface is disposed on and within the housing and has an inner diameter that is greater than the outer diameter of the striking tool and than the inner diameter of the inner portion of the striking tool guide.

13. The device according to claim 1, wherein the seal has at least one sealing lip that extends at an incline in the striking direction, and is held in contact in an elastic manner against the countersurface.

14. The device according to claim 13, wherein the ratio of the length of each sealing lip to the largest-possible transverse offset of the striking tool relative to the housing is at least 1 to 3.

15. A percussion device having a protective apparatus for preventing the infiltration of contaminants, said device comprising: a fluid-operated percussion device, having a striking tool that is guided to move in a housing by a striking tool guide, and is driven by a percussion piston in the striking direction, and a seal that is supported at least indirectly on one of the housing and the striking tool and has a securing portion that is fixedly disposed with respect to one of the housing and the striking tool, with the seal being disposed between an inner guide portion of the striking-tool guide and a theoretical striking plane of the percussive piston on the striking tool, when seen in the direction opposite the striking direction, and a countersurface provided on said one of the striking tool and the housing tool, which countersurface moves relative to the securing portion of the seal, is in contact with the seal, and is unaffected by wear; and wherein the seal is connected by its securing portion to an exchangeable receiving sleeve that in turn is secured to one of the striking tool and the housing, and the receiving sleeve constitutes a component of the cushioning ring.

16. A percussion device having a protective apparatus for preventing the infiltration of contaminants, said device comprising: a fluid-operated percussion device, having a striking tool that is guided to move in a housing by a striking tool guide, and is driven by a percussion piston in the striking direction, and a seal that is supported at least indirectly on one of the housing and the striking tool and has a securing portion that is fixedly disposed with respect to one of the housing and the striking tool, with the seal being disposed between an inner guide portion of the striking-tool guide and a theoretical striking plane of the percussive piston on the striking tool, when seen in the direction opposite the striking direction, and a countersurface provided on said one of the striking tool and the housing tool, which countersurface moves relative to the securing portion of the seal, is in contact with the seal, and is unaffected by wear; and wherein a diameter of the striking tool over the length of the countersurface is smaller than a diameter of the striking tool in the region of the inner guide portion, whereby the countersurface does not engage an inner surface of the inner guide portion.

17. A percussion device having a protective apparatus for preventing the infiltration of contaminants, said device comprising: a fluid-operated percussion device, having a striking tool that is guided to move in a housing by a striking tool guide, and is driven by a percussion piston in the striking direction, and a seal that is supported at least indirectly on one of the housing and the striking tool and has a securing portion that is fixedly disposed with respect to one of the housing and the striking tool, with the seal being disposed between an inner guide portion of the striking-tool guide and a theoretical striking plane of the percussive piston on the striking tool, when seen in the direction opposite the striking direction, and a countersurface provided on said one of the striking tool and the housing tool, which countersurface moves relative to the securing portion of the seal, is in contact with the seal, and is unaffected by wear; and wherein the seal is formed as an outwardly directed seal and is fixedly held by its securing portion relative to the striking tool.

18. The device according to claim 17, wherein the countersurface is disposed on and within the housing and has an inner diameter that is greater than the outer diameter of the striking tool and than the inner diameter of the inner portion of the striking tool guide.

* * * * *